US010189074B2

(12) United States Patent
Allwood et al.

(10) Patent No.: US 10,189,074 B2
(45) Date of Patent: Jan. 29, 2019

(54) RING ROLLING PROCESS AND APPARATUS FOR RING ROLLING

(71) Applicant: Cambridge Enterprise Limited, Cambridge (GB)

(72) Inventors: Julian Allwood, Cambridge (GB); Christopher Cleaver, Cambridge (GB)

(73) Assignee: Cambridge Enterprise Limited, Cambridge (GB)

( * ) Notice: Subject to any disclaimer, the term of this patent is extended or adjusted under 35 U.S.C. 154(b) by 26 days.

(21) Appl. No.: 15/547,749

(22) PCT Filed: Mar. 4, 2016

(86) PCT No.: PCT/GB2016/050579
§ 371 (c)(1),
(2) Date: Jul. 31, 2017

(87) PCT Pub. No.: WO2016/142661
PCT Pub. Date: Sep. 15, 2016

(65) Prior Publication Data

US 2018/0021842 A1 Jan. 25, 2018

(30) Foreign Application Priority Data

Mar. 6, 2015 (GB) ..... 1503825

(51) Int. Cl.
*B21H 1/06* (2006.01)
*B21B 5/00* (2006.01)

(52) U.S. Cl.
CPC ..... *B21H 1/06* (2013.01); *B21B 5/00* (2013.01)

(58) Field of Classification Search
CPC ..... B21B 5/00; B21H 1/06
See application file for complete search history.

(56) References Cited

FOREIGN PATENT DOCUMENTS

DE 1151776 B * 7/1963 ..... B21H 1/06
DE 3632436 A1 4/1988
(Continued)

OTHER PUBLICATIONS

Hawkyard, J. B., & Moussa, G.: Studies of Profile Development and Roll Force in Profile Ring Rolling. Proceedings of the 3rd International Conference on Rotary Metalwork Processes (1984) pp. 301-310.

(Continued)

*Primary Examiner* — Teresa M Ekiert
(74) *Attorney, Agent, or Firm* — Adsero IP

(57) ABSTRACT

A ring rolling process and corresponding apparatus are disclosed. A ring shaped workpiece is provided, the ring shaped workpiece having a principal axis, an inner radial surface, an outer radial surface, a first axial surface and a second axial surface. The workpiece is subjected to radial pressure between a forming roll 150*a* acting on the outer radial surface and a mandrel roll 152*a*, 152*b* acting on the inner radial surface, at a radial roll bite region. A first axial roll 154*a* and a second axial roll 156*a* are provided at the first axial surface and the second axial surface respectively, to subject the workpiece to axial pressure. The first and second axial rolls 154*a*, 156*a* are provided at an angular position, measured around the workpiece and with respect to the principal axis, within ±10° of said radial roll bite region. Multiple circumferential constraint rolls are provided around the outer radial surface or inner radial surface. In order to control the cross sectional shape of the workpiece, the mandrel roll 152*a*, 152*b* and/or the forming roll 150*a* has a projecting portion for contact with the workpiece, the projecting portion having an axial extent which is smaller than the axial height of the workpiece, the mandrel roll and/or forming roll being axially moveable relative to the workpiece.

14 Claims, 14 Drawing Sheets

(56) References Cited

FOREIGN PATENT DOCUMENTS

| | | | | |
|---|---|---|---|---|
| EP | 244176 | A1 | 4/2012 | |
| EP | 2626153 | A1 | 8/2013 | |
| FR | 2040631 | A | 1/1971 | |
| FR | 2040631 | A5 * | 1/1971 | ..... B21H 1/06 |
| JP | S60223631 | A | 11/1985 | |
| JP | 2002-239606 | A | 8/2002 | |
| JP | 2012-232335 | A | 11/2012 | |
| JP | 2013-146777 | A | 8/2013 | |
| WO | WO 2014-095732 | A1 | 6/2014 | |
| WO | WO 2014-095733 | A1 | 6/2014 | |
| WO | WO 2015-003696 | A1 | 1/2015 | |

OTHER PUBLICATIONS

Marczinski, H. J.: The Hot Ring Rolling Process and its Integration into Automatic Production Lines. Proceedings of the 3rd International Conference on Rotary Metalwork Processes (1984). pp. 251-265.

Qian, D.-S., Hua, L., & Pan, L.-B.: Blank design optimisation for T-section ring rolling. Ironmaking & Steelmaking, (2009) 36(6).

Souza, U. De, Vaze, S., Pursell, Z., & Phillips, K. Profile Ring Rolling. Advanced Materials & Processes, (2003) May 35-37.

Tiedemann, I., Hirt, G., Kopp, R., Michl, D., & Khanjari, N.: Material flow determination for radial flexible profile ring rolling. Production Engineering, (2007) 1(3).

Qian, D., Hua, L., & Deng, J.: FE analysis for radial spread behavior in three-roll cross rolling with small-hole and deep-groove ring. Transactions of Nonferrous Metals Society of China, (2012) 22.

Han, X., Hua, L., Zhou, G., Lu, B., & Wang, X.: FE simulation and experimental research on cylindrical ring rolling. Journal of Materials Processing Technology, (2014) 214(6), 1245-1258.

Ficker, T., Hardtmann, A., & Houska, M. Ring Rolling Research at the Dresden University of Technology—its History from the Beginning in the 70 s to the Present. Steel Research International. (2005).

Stanistreet, T. F., Allwood, J. M., & Willoughby, A. M.: The design of a flexible model ring rolling machine. Journal of Materials Processing Technology, (2006). 177(1-3), 630-633 [10] Xinghui Han, Lin Hua, Guanghua Zhou, Bohan Lu, Xiaokai Wang; A new cylindrical ring rolling technology for manufacturing thin-walled cylindrical ring, International Journal of Mechanical Sciences, vol. 81, Apr. 2014, pp. 95-108.

Cleaver, J. C., Allwood, J. M.; Achievable geometries in flexible radial profile ring rolling. International Seminar on Precision Forging.

International Search Report and Written Opinion issued in PCT/GB2016/050579 dated May 23, 2016; 13 pages.

* cited by examiner

RING ROLLING PROCESS AND APPARATUS FOR RING ROLLING

RELATED APPLICATIONS

This application is a 35 U.S.C. § 371 national phase application of PCT/GB2016/050579 (WO2016/142661), filed on Mar. 4, 2016 entitled "RING ROLLING PROCESS AND APPARATUS FOR RING ROLLING" which application claims the benefit of Application Ser. No. GB-1503825.0, filed Mar. 6, 2015, which is incorporated herein by reference in its entirety.

BACKGROUND TO THE INVENTION

Field of the Invention

The present invention relates to a ring rolling process, a ring rolling apparatus and products obtained or obtainable using the ring rolling process and/or apparatus. Ring rolling is a category of materials forming, in particular metal forming.

Related Art

Ring rolling is a bulk metal forming process that typically generates large (1-5 m diameter, for example) metal rings for engineering applications such as aerospace, energy conversion and oil and gas extraction industries.

A metal workpiece in the shape of a ring having a starting outer diameter is rolled into a seamless ring of diameter larger than the starting diameter. Considering a ring-shaped workpiece having an axisymmetric shape and a rectangular cross section, the surfaces of the workpiece can be defined as radial surfaces and axial surfaces. An inner radial surface is located at the inner circumference of the workpiece and an outer radial surface at the outer circumference of the workpiece, each coaxial with the principal axis of the workpiece and orthogonal to the radial direction of the workpiece. First and second axial surfaces (e.g. upper and lower axial surfaces) are parallel to the radial direction of the workpiece and orthogonal to the principal axis of the workpiece.

Ring rolling processes known as radial ring rolling processes use two rolls, a forming roll (typically driven) acting on the outer radial surface of the workpiece and a mandrel roll (typically idle) acting on the inner radial surface of the workpiece. The ring is progressively reduced in cross sectional area, resulting in a corresponding increase in the diameter of the ring.

As a modification of radial ring rolling, radial-axial ring rolling processes are known which add axial rolls diametrically opposite the forming and mandrel rolls, i.e. on the other side of the ring. A typical arrangement for radial-axial ring rolling is shown in FIGS. 1A and 1B. Workpiece 10 is progressively formed between forming roll 12 and mandrel roll 16, acting on outer radial surface 14 and inner radial surface 18 respectively. Two guide rolls 20, 22 bear against the outer radial surface 14 of the workpiece to centre and stabilize the workpiece. At a position which is 180° angularly displaced around the principal axis A of the ring from position 24 of the roll bite between the forming roll 12 and mandrel roll 14, lower axial roll 26 and upper axial roll 28 bear against the first 30 and second 32 axial surfaces of the workpiece 10, in order to control the axial height of the workpiece as it is formed.

Han et al [Reference 11] disclosed the possibility of a ring rolling process in which the diameter and thickness of the workpiece are reduced during the forming process (as in the process described with respect to FIGS. 1A and 1B) but also the height of the workpiece (the axial extent of the workpiece along the principal axis direction) is increased. Intervening between the forming roll and the workpiece is a constraint cylinder. As the workpiece is progressively deformed, the axial height and diameter of the workpiece increase, the limit of the outer diameter of the workpiece corresponding to the inner diameter of the constraint cylinder, but the growth in the axial height not being constrained.

The discussion above is restricted to the formation of rings of rectangular cross section. It is also known to be of interest to form rings of more complex cross section. This is of particular interest where the desired end product has a relatively complex cross section. One approach to form such shapes is to form a rectangular cross section ring and then machine it to shape. However, this results in a low yield process, in the sense that much of the material of the original workpiece is removed. Furthermore, some benefits of ring rolling (in particular the generation of fine and/or textured microstructures near the surface of the workpiece) may be lost, at least in part. It is to be noted that other benefits of ring rolling are typically improved process speed compared to forging and improved microstructure compared to casting.

In principle a ring of complex cross sectional shape can be achieved using a shaped mandrel roll, shaped forming roll, or both, in order to form a near net shape product. However, a drawback of this approach is that different desired cross sectional shapes require the use of different forming tools, meaning that low volume production of complex cross sectional shapes by ring rolling is not cost effective.

FR-A-2040361 discloses a ring rolling process in which a forming roll, mandrel roll and first and second axial rolls are displaceable along their axes of rotation in order to accommodate a reduction in cross sectional area of the workpiece during ring rolling, in a configuration similar to that shown in FIG. 14 of this disclosure and discussed in more detail below. As such, the disclosure of FR-A-2040361 is limited to the production of rectangular cross sectional shapes only. Separately, FR-A-2040361 also discloses a ring rolling process in which the forming roll has a particular shape which is imparted to the workpiece in order to generate a non-rectangular cross section. It is clear from the disclosure of FR-A-2040361 that the shaped forming roll is not displaceable along its axis of rotation relative to the workpiece, and thus the cross sectional shape achievable is strictly limited to the cross sectional shape corresponding to the outer surface of the forming roll. The shaped forming roll is also not independently axially positionable relative to the mandrel roll in FR-A-2040361.

Tiedemann et al [Reference 5] disclose an approach in which one forming tool (in this case a mandrel roll) can be used to generate different cross sectional shapes in the workpiece by control over the axial and radial movement of that forming tool. The approach of Tiedemann et al is illustrated in FIG. 2 (taken from Reference 5) in which the forming roll 40 and guide rolls 42, 44 are located as in FIGS. 1A and 1B. Mandrel roll 46 has an annular projection 48. The mandrel roll is capable of radial movement but also capable of axial movement. This has the result of forming different profile shapes for the inner radial surface of the workpiece 50. It should be noted, however, that Tiedemann et al have not demonstrated control of the movement of the mandrel roll resulting in a required workpiece shape. Rather, Tiedemann et al have considered the resultant workpiece shape based on a predetermined movement of the mandrel roll.

SUMMARY OF THE INVENTION

The present inventors have studied issues relating to material flow in the workpiece during ring rolling. This has led to new insights into ring rolling processes and the development of the present invention. In particular, the present invention aims to provide improved control over the cross sectional shape of the workpiece during ring rolling. The present invention aims to generate a particular workpiece shape by controlling the material flow as explained in more detail below.

Axial rolls are used to provide an additional constraint compared with the disclosure of Tiedemann, so that when the profiled mandrel or forming roll is moved axially, there is additional control over the material flow which allows the desired workpiece shape to be achieved more predictably.

Accordingly, in a first aspect, the present invention provides a ring rolling process as disclosed herein.

In a second aspect, the present invention provides a ring rolling apparatus as disclosed herein.

The present inventors have found that positioning the axial rolls in this manner allows improved control over the material flow characteristics in the forming process, and consequently the ability to control the cross sectional shape of the workpiece (as determined by axial movement of the profiled mandrel and/or forming roll) more accurately during circumferential growth of the ring. The inventors consider that positioning the axial rolls as defined provides a substantial advantage over previous arrangements in which axial rolls are positioned at 180° from the radial roll bite region, measured with respect to the principal axis of the ring shaped workpiece, in which the effect of each set of rolls is therefore spatially separated. A further advantage provided by the arrangement defined above is that there is greater stability during the process because the workpiece is prevented from climbing up the mandrel roll (or forming roll).

The mandrel roll may have a projecting portion for contact with the workpiece. The projecting portion may have an axial extent which is smaller than the axial height of the workpiece, e.g. the starting axial height of the workpiece at the beginning of the process. In this case, the mandrel roll is axially moveable relative to the workpiece during the ring rolling process. In this way, the projecting portion of the mandrel roll can be applied to different axial locations of the workpiece, in order to control the shape applied to the workpiece. This approach is advantageous, because it allows the ring rolling process to be controlled, by control over the movement of the mandrel roll, in order to generate different required shapes to the workpiece without changing the tooling on the apparatus. Therefore this approach is well suited to the manufacture of one-off or small numbers of ring shaped components of complex cross sectional shape.

The features described above with respect to the mandrel roll may be provided alternatively or additionally at the forming roll. That is, the forming roll may have a projecting portion for contact with the workpiece. The projecting portion may have an axial extent which is smaller than the axial height of the workpiece, e.g. the starting axial height of the workpiece at the beginning of the process. In this case, it is preferred that the forming roll is axially moveable during the ring rolling process.

Preferably, the forming roll is independently positionable relative to the mandrel roll. Preferably, the mandrel roll is independently positionable relative to the forming roll.

The first and/or second aspect of the invention may have any one or, to the extent that they are compatible, any combination of the following optional features.

During ring rolling, the forming roll makes contact with the work piece over a contact area of the outer radial surface of the workpiece. Similarly, the mandrel roll makes contact with the workpiece over a contact area of the inner radial surface of the workpiece. These contact areas define the extent of the radial roll bite region. In the absence of the workpiece, it can be seen that the radial roll bite region is located at least at the position of minimum distance between the forming roll and the mandrel roll. When the workpiece is present, depending on the degree of reduction being applied to the workpiece with each pass, the radial roll bite region extends upstream of the position of minimum distance between the forming roll and the mandrel roll.

In a similar manner, the first axial roll makes contact with the work piece over a contact area of the first axial surface of the workpiece. Similarly, the second axial roll makes contact with the workpiece over a contact area of the second axial surface of the workpiece. These contact areas define the extent of the axial roll bite region. In the absence of the workpiece, it can be seen that the axial roll bite region is located at least at the position of minimum distance between the first and second axial rolls. When the workpiece is present, depending on the degree of reduction being applied to the workpiece with each pass, the axial roll bite region extends upstream of the position of minimum distance between the first and second axial rolls.

Preferably, the axial roll bite region and the radial roll bite region overlap in terms of angular position around the workpiece. In this way, preferably the axial rolls affect the material flow generated by the forming and mandrel rolls, and vice versa.

More generally, it is possible for the first and second axial rolls to be provided at an angular position, measured with respect to the principal axis of the ring shaped workpiece, within ±5° of said radial roll bite region, or within ±2° of said radial roll bite region or coincident with said radial roll bite region.

The mandrel roll typically rotates about an axis parallel to the principal axis of the workpiece. Similarly, the forming roll typically rotates about an axis parallel to the principal axis of the workpiece.

The axial rolls typically rotate about respective axes that are not parallel to the principal axis of the workpiece. In some embodiments, their axes of rotation may be parallel to a radial direction of the workpiece. However, in other embodiments, their axes of rotation may be intermediate between parallel to the principal axis and parallel to a radial direction of the workpiece.

Preferably, the axial rolls are idling rolls (i.e. preferably they are not driven in use but are rotated by contact with the rotating workpiece).

Preferably the forming roll is driven. The mandrel roll may be an idling roll. Alternatively, the mandrel roll may be driven. In that case, the forming roll may be an idling roll.

In an alternative arrangement, one or both of the axial rolls may be driven. This may be the case in particular if the aim of the forming process is to generate a ring which is relatively flat and shallow with respect to the starting dimensions of the workpiece. In this alternative arrangement, both the mandrel roll and the forming roll may be idling rolls.

There may be provided circumferential constraint rolls. These can be positioned to act on the outer radial surface or inner radial surface of workpiece. Preferably, the circumferential constraint rolls are adapted so that they can be positioned on either the outer radial surface or inner radial surface of workpiece, without changing the tooling of the apparatus.

The circumferential constraint rolls preferably act to control the compressive or tensional hoop stress in the workpiece, and to stabilise and centre the workpiece. The present inventors have found that such control leads to greater control of the material flow characteristics at the radial roll bite region, and therefore greater control over the shape of the product. The circumferential constraint rolls enable additional control over circumferential flow of material and further improve the range of workpiece shapes that can be produced.

In the case where the circumferential constraint rolls act to control the compressive or tensional hoop stress in the workpiece, the present inventors consider that this amounts to an independent aspect of the invention, not restricted by the requirement for the first and second axial rolls (and/or their position) set out with respect to the first and second aspects of the invention.

There may be provided more than two circumferential constraint rolls. It is considered that there may be three, four, five, six or seven circumferential constraint rolls. Preferably, the circumferential constraint rolls are angularly distributed substantially regularly around the workpiece.

In the case where there are provided more than two circumferential constraint rolls, the present inventors consider that this amounts to an independent aspect of the invention, not restricted by the requirement for the first and second axial rolls (and/or their position) or the shape or moveability of the mandrel or forming rolls, set out with respect to the first and second aspects of the invention.

Where the mandrel and/or forming rolls are axially moveable in order to control the cross sectional shape of the workpiece, the circumferential constraint rolls preferably have the same shape as the mandrel and/or forming rolls and are preferably similarly axially moveable. In this way, the axial movement of the mandrel and/or forming rolls and the circumferential constraint rolls can be linked in order to control the hoop stress in the workpiece.

Preferably, the workpiece is axisymmetric and the end product is axisymmetric. However, in some embodiments, at least the end product may be non-axisymmetric. This can be achieved by control over the positions of the rollers during each rotation of the workpiece. Using computer numeric control (CNC) systems, for example, the workpiece can be formed to a required non-axisymmetic shape by controlling the positions of the rollers during each revolution to follow and apply the required shape to the workpiece. Such shapes are of interest, for example, for manufacturing a triple ring eccentric bearing, of the type offered by FAG Industries and described at:

http://www.schaeffler.com/remotemedien/media/ shared media/08 media library/01 publications/schaeffler 2/publication/downloads 18/wl 235023 de en.pdf [URL accessed 27 Feb. 2016].

Non-axisymmetric shapes may also be useful in gas turbine machinery, for example near the combustion chamber of a gas turbine.

The invention is applicable in principle to workpieces formed from any material that can be plastically worked. However, the invention is particularly suitable to metal-working, preferred materials being ferrous alloys, including steel, aluminium and aluminium alloys, nickel and nickel alloys, titanium or titanium alloys, or combinations of such materials.

Further optional features of the invention are set out below.

BRIEF DESCRIPTION OF THE DRAWINGS

Embodiments of the invention will now be described by way of example with reference to the accompanying drawings in which.

DETAILED DESCRIPTION OF THE PREFERRED EMBODIMENTS, AND FURTHER OPTIONAL FEATURES OF THE INVENTION

In the preferred embodiments of the present invention, additional degrees of flexibility are provided compared with known radial profile ring rolling techniques. This offers increased material yield and reduced downstream machining costs, without necessarily requiring expensive part-specific tooling. In the studies underpinning this work, a different approach is taken compared with previous experimental studies. Three key flow patterns are classified, these flow patterns observed in the outer and inner profiling of a ring of intended L-shaped cross-section: axial flow and uniform/non-uniform circumferential flow. The axial height ratio of thick to thin sections and the ring aspect ratio are considered to be key factors determining which of these flow patterns occur. The trends in these factors suggests certain limits to the range of final geometries achievable by simple flexible radial profile ring rolling, in view of undesirable non-uniform flow.

Ring rolling is a bulk metal forming process that typically generates large (1-5 m diameter) metal rings for engineering applications such as aerospace, energy conversion and oil and gas extraction industries. The process conventionally creates metal rings with a rectangular cross-section, unless a 'profiled' tool set is generated to suit each application. Thus, in numerous low-volume ring rolling applications when producing a profiled tool is uneconomical a rectangular ring is made and machined to the final geometry. This results in considerable yield losses—the difference between input material and material in the finished product—and additional machining costs. Ideally, with a single set of 'universal' tools, it would be possible to convert rectangular/barrelled metal ring preforms into a wide range of radially profiled rings.

Figure 1A:
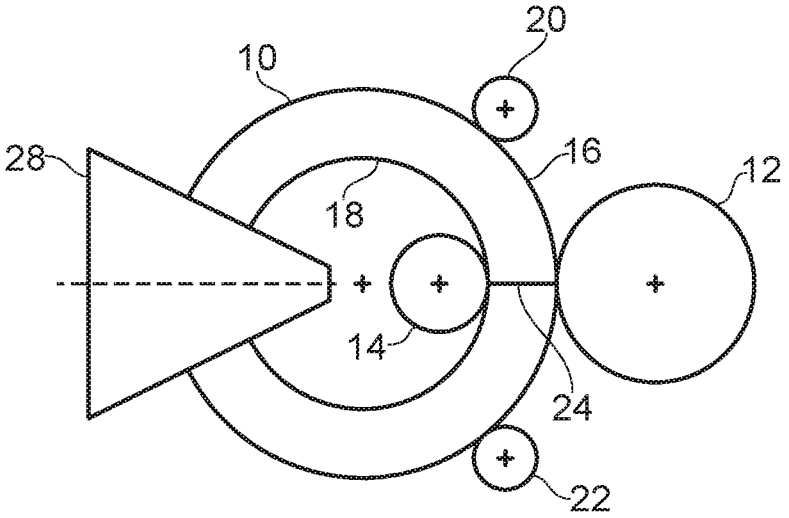
FIG. 1A (Prior Art)
FIG. 1A shows a schematic plan view of a known ring rolling arrangement.
Figure 1B:
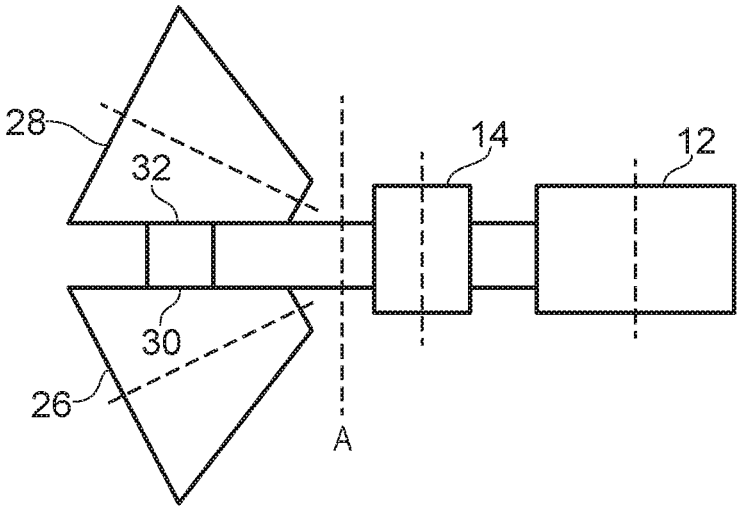
FIG. 1B (Prior Art)
FIG. 1B shows a schematic partial sectional view of the arrangement of FIG. 1A.

A typical radial-axial ring rolling machine is shown in FIGS. 1A and 1B. A thick-walled ring-shaped workpiece 10 is thinned in the radial roll bite, between a powered forming roll 12 and idly rotating inner mandrel roll 14. Two guide rolls 20, 22 centre and stabilize the ring 10. A second pair of tools, the lower 26 and upper 28 axial rolls, control the axial height of the ring.

The machine set-up of FIGS. 1A and 1B can be used to generate a non-rectangular shaped ring cross-section if part-specific shaped tooling is used. Inner radial profiles require a shaped mandrel, while outer radial profiles require a shaped forming roll and guide rolls.

A comprehensive experimental study into profile ring rolling at University of Manchester Institute of Science and Technology, UK, showed that profile filling—the extent to which the cross-section of the workpiece is changed by the profiled tool—requires internal axial flow of material from the radial section that is thinned the most into the section that is thinned the least. However, this is not guaranteed to occur [Reference 1]. The study concluded that in some cases adequate profile filling could only be achieved by starting with ring preforms that are initially shaped. Furthermore, in some applications a set of intermediate profiled tools were needed. Similar conclusions were drawn by Marczinksi [Reference 2] in a discussion of industrial practice in the 1980s; and in FEM simulation studies such as Reference 3. The need for intermediate tooling in generating thin-walled rings such as aero engine casings is also emphasised in the context of reducing yield losses in the industry [Reference 5].

The part specific tooling required for profile ring rolling can be prohibitively expensive to develop for low-volume applications. This motivated work into flexible, or incremental, radial profile ring rolling.

Figure 2:
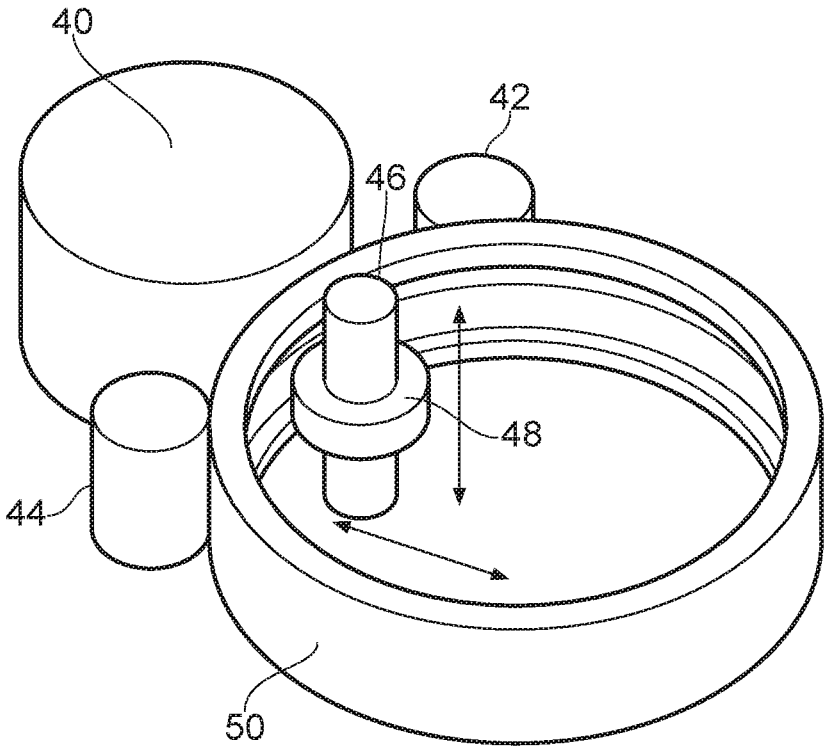
FIG. 2 (Prior Art)
FIG. 2 shows a schematic layout of the ring rolling arrangement of Reference 5.

An experimental flexible machine to process wax rings was developed at RWTH Aachen, Germany. FIG. 2 shows the schematic layout of this machine, with an inner mandrel 46 that can move axially (vertically) and thus thin sections of the ring 50 incrementally. Because the tool acts on a small section of an otherwise unconstrained ring, there is an even greater range of possible material flow patterns than in conventional profile rolling. An empirical model for material flow was developed by Tiedemann [Reference 5], predicting the geometrical outcome of a simple tool movement. However, crucially this does not seem to have been 'inverted' to a) determine the tool movements required to achieve a certain shape and b) map out the range of shapes that can actually be achieved with this tooling set-up.

Research is ongoing into novel machine set-ups to improve shaping. Three-roll cross-rolling has been investigated at Wuhan University of Technology, China. In this process, a thick-walled ring is formed between an outer forming roll and two outer 'passive rolls' opposite. Good filling of a deep outer radial groove was achieved; the passive rolls appear to enable the internal axial flow required for profile filling by preventing circumferential flow [Reference 6].

Research into cylindrical ring rolling has shown that it is possible to constrain a ring with a solid sleeve around its circumference, allowing only axial material flow (perpendicular to the conventional 'rolling direction'). This method led to improved filling of an inner profile [Reference 7].

The promotion of axial flow has also been investigated at Dresden University of Technology, Germany. In this technique, outer profiles are incrementally created on long, tubular rings [Reference 8]. A small section of tube is thinned radially by a profiled tool, and since circumferential flow is prevented by the rest of the workpiece the material flows axially.

However, none of these methods could be considered flexible: it is necessary to develop specific tooling for each new part. As yet, to the knowledge of the inventors at the time of writing, no solution exists for reliably generating shaped profiles from non-shaped blanks without part specific tooling. The basis for this solution could lie in an understanding of the flow patterns observed in flexible radial ring rolling, allowing us to determine the range of ring geometries that are achievable.

In order to understand the response of a ring workpiece to incremental radial thinning, an experimental study was carried out on a model ring rolling machine at University of Cambridge, UK. The machine was developed to investigate the effect of novel machine set-ups on achievable ring geometries [Reference 9]. The arrangement of the machine at the radial roll bite is shown schematically in FIG. 3. The workpiece 60 is shown in cross section, along with the forming roll 62, a support roll 64 and a mandrel roll 66. The mandrel roll is capable of axial movement, as well as radial movement, in order to provide a stepped-shape inner radial surface to the workpiece during rolling.

Figure 3:
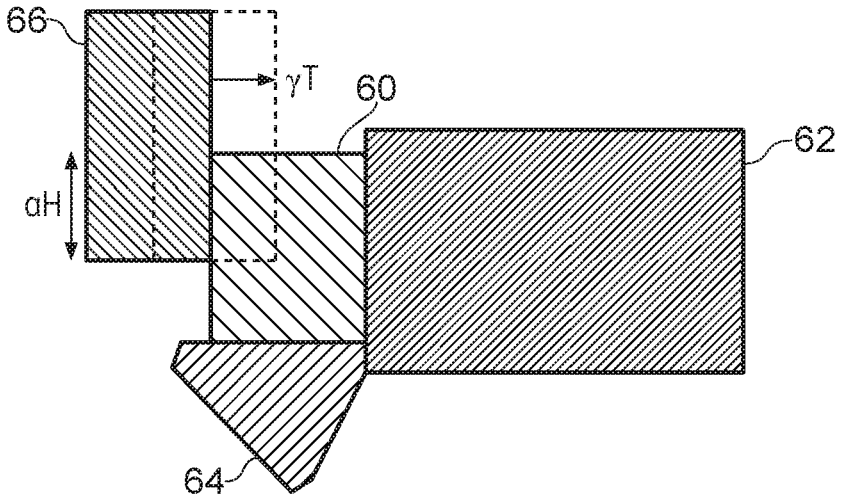
FIG. 3 (Prior Art)
FIG. 3 shows a schematic partial sectional view of the arrangement of rolls at the radial roll bite region of a ring rolling machine according to Reference 9.

In FIG. 3, $\alpha$ refers to the proportion of the workpiece ring height H acted on by the mandrel roll. $\gamma$ refers to the reduction in thickness of the workpiece compared with the initial workpiece thickness T.

The results from a chosen sub-set of these experiments in which L-shaped profiles were targeted are discussed below. This type of profile resulted in an interesting range of flow patterns, which are summarised further below. It is thought to be representative of some industrially relevant parts such as weld-neck flanges.

The model material plasticine, a proprietary oil-clay mixture, was used for the experiments. It has been widely used in prediction of flow patterns in metalworking since it has a similar stress-strain flow curve to engineering metals (distinct yield, strain rate hardening), see for example Reference 10.

Figure 4A:
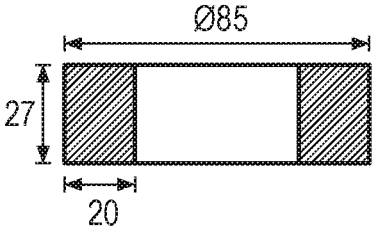
FIGS. 4A and 4B show schematic cross sectional views of workpiece geometries used in the assessment of material flow.
Figure 4B:
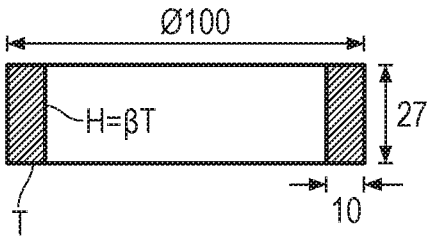

Ring preforms were prepared in a mould; two sizes were developed representative of a 'thick' and 'thin' walled ring, with differing ratio ($\beta$) of axial height (H) to wall thickness (T). These are shown in FIGS. 4A and 4B respectively, the measurements being in mm.

Six experiments were carried out on each size of preform. Each ring was partially indented by the mandrel to approximately 50% ($\gamma$) of its original thickness, over 25, 50, or 75% ($\alpha$) of its original axial height, on both the outer or inner radial surface. This therefore amounts of outer and inner profiling.

Figure 5:
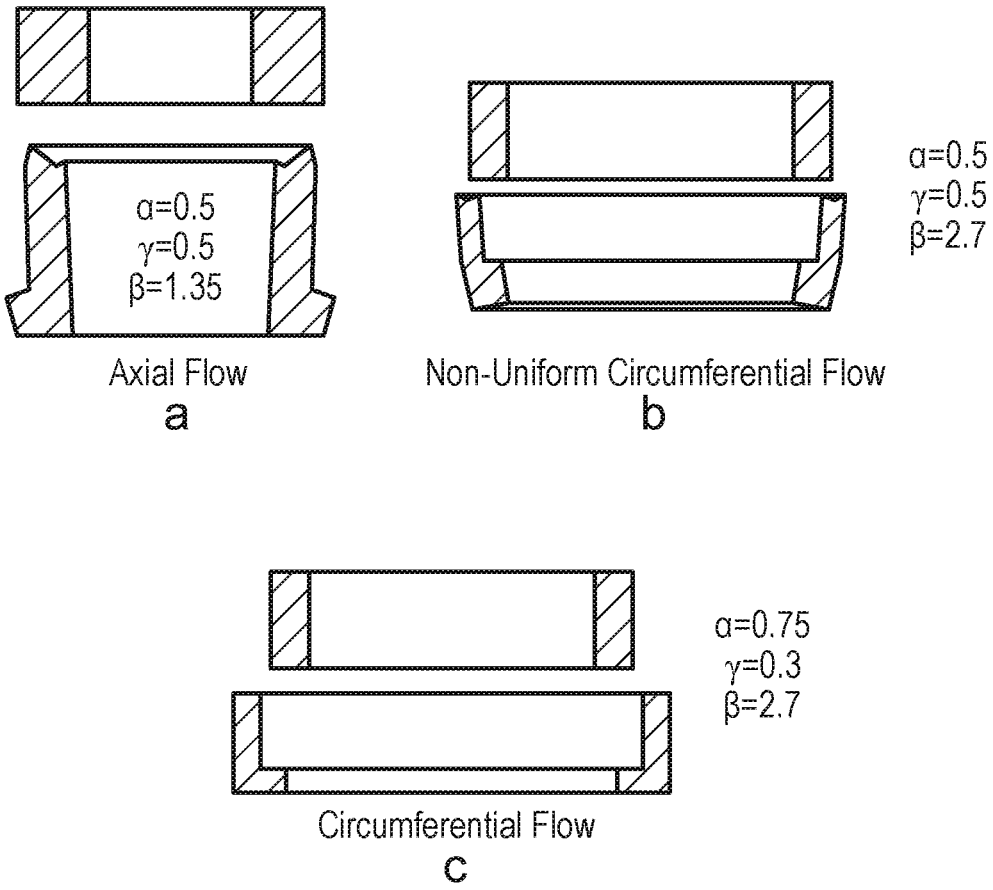
FIG. 5 shows illustrations of different flow patterns due to flexible radial rolling processes.

Three main flow patterns were observable within the results: axial flow, non-uniform and uniform circumferential flow, as illustrated in FIG. 5.

FIG. 5*a* shows the cross-section of a ring that has principally undergone axial material flow. In this experiment on a thick-walled preform, the outer forming roll tool acted over 50% of the ring's initial height ($\alpha$=50%). The ring has mostly grown in height, and hardly at all circumferentially, indicating that axial material flow was dominant. It appears that the bottom section of the ring was sufficiently large that it remained almost rigid; it was not possible for the action of the tool to achieve sufficient hoop stress in this region for circumferential yield.

The second flow pattern, non-uniform circumferential flow, is shown in FIG. 5*b*. In this, an inner profile was generated with $\alpha$=50%, but on a thin-walled preform (FIG. 4B). The ring appears almost conical, with the upper section growing in circumference, and the lower section less so, leading to a 'bent' cross-section. There must have been sufficient tensile hoop stress developed in the lower section to allow it to be partially stretched and bent, allowing the upper section to flow in the rolling direction (and slightly axially).

Finally, FIG. 5*c* shows uniform circumferential flow, for an inner profile with $\alpha$=75%. The ring cross-section remains square as originally intended. This seems to be possible because: a) sufficient material is able to flow internally axially from the top to bottom sections, and b) sufficient hoop stress is developed for it to yield circumferentially.

Analytical modelling and simulation has been carried out in order to predict flow patterns in flexible radial ring rolling of the type described above. Predictions into when a particular flow pattern will occur were made by an upper bound approach, and also inferred from a finite element method (FEM) study of inner profiling.

In the upper bound approach an idealised rigid-plastic velocity field was made for each flow pattern. It was assumed that the velocity field requiring the least work input (plastic work, shear at discontinuities, and friction at the rolls) will be indicative of the real flow pattern.

Figure 6:
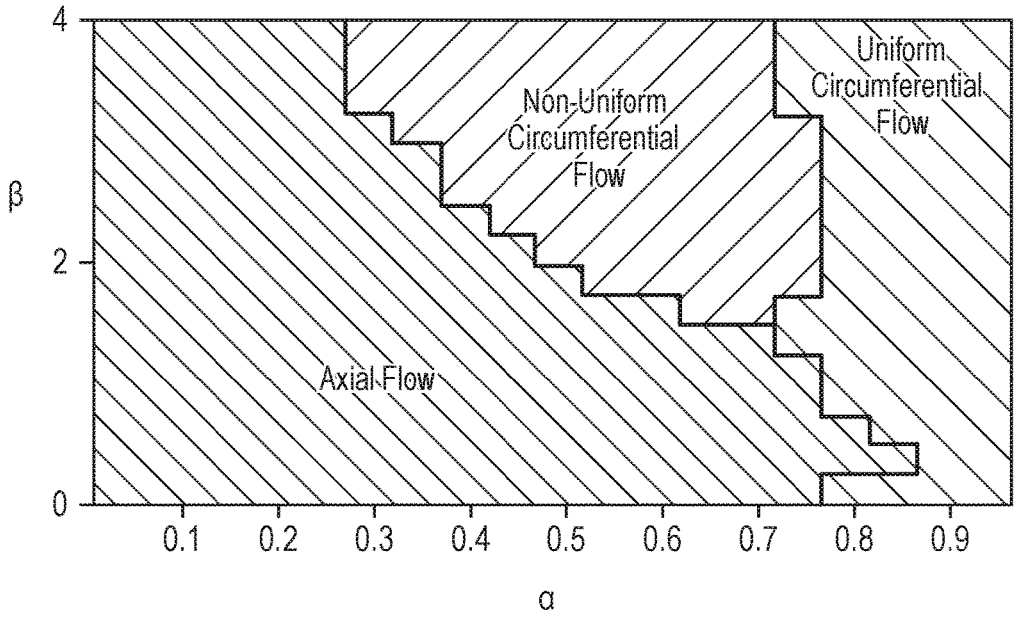
FIG. 6 plots the results of an upper bound approach to determine the flow mode for different ratios of $\beta$ (ordinate) and $\alpha$ (abscissa).

FIG. 6 shows the results of this upper bound approach by plotting the mode with least work for discretized ratios of $\beta$ and $\alpha$.

If the tool acts over a small section of the ring (small $\alpha$), axial flow is predicted. For large $\alpha$, uniform circumferential flow is predicted. For intermediate values of $\alpha$, the ring height to thickness ratio, $\beta$, becomes important: thinner walled rings (large $\beta$) are predicted to show non-uniform circumferential growth.

Figure 7:
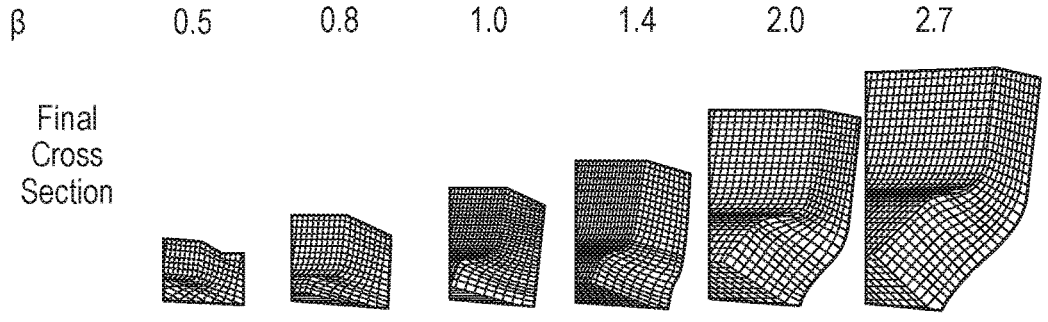
FIG. 7 shows the results of prediction of flow patterns via FEM simulation, illustrating the predicted final cross section of the workpiece for different values of $\beta$.

A parametric study was made into the effect of varying the ratio $\beta$ for $\alpha$=50%, using a series of 3D FEM simulations. The simulations were carried out in ABAQUS, with the explicit solver. The simulation suggests a transition from axial growth to non-uniform circumferential growth, as shown in FIG. 7. This is broadly consistent with the experimental results and upper bound analysis prediction.

Figure 8:
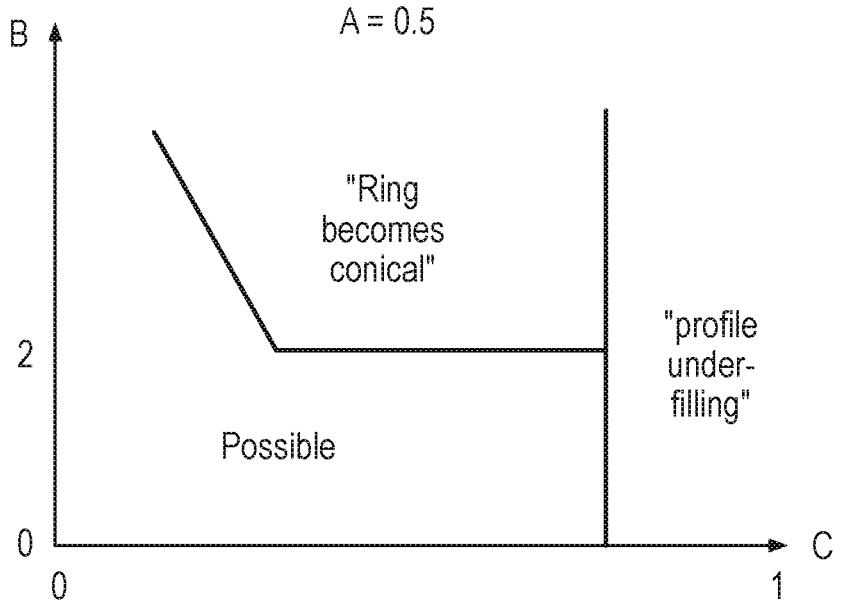
FIG. 8 illustrates the operating window for forming L-shapes for different values of C and B where A=0.5.
Figure 9:
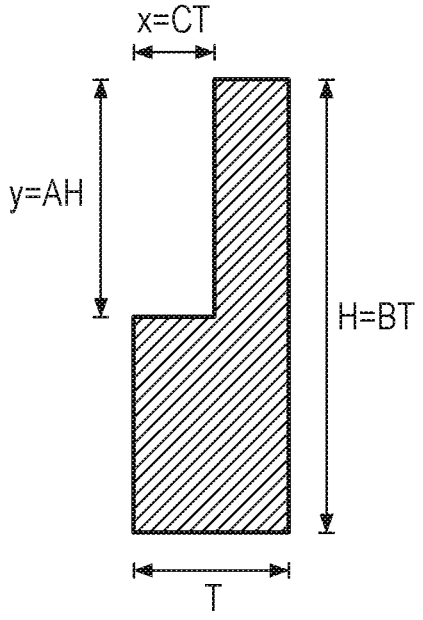
FIG. 9 illustrates A, B and C for FIG. 8.

An illustrative evaluation is now made into the range of achievable geometries from a flexible radial ring rolling process as described above. An operating window approach is used, for L-shapes with a final (not initial) geometry ratio, A=0.5, varying B, and C—see FIG. 9 for an explanation of A, B and C and see FIG. 8 for the operating window. A is the axial proportion of the ring that is thinner compared to the final (and not initial) ring height. B is the aspect ratio of the final cross-section, and C is the final thickness ratio (i.e. thick-thin/thick.

There is potential to make use of axial flow by first rolling to the required outer radius and then shaping the ring upwards. This strategy is limited to relatively low aspect ratio rings (B<1.5-2). There is a probable upper limit on the variation in thickness (e.g. C>0.75). For large B, although the non-uniform circumferential flow mode appears to generate rings with unacceptable conicity, it might be possible to make use of this flow pattern by first acting on the surface of the ring that is to be thinned most, and then acting on the bottom section so as to correct for the conical shape. However, this approach is unlikely to achieve high profile filling (C>0.2-0.4), and would require careful control of the order and amount of indentation on each pass.

On the basis of the work reported above, a ring rolling process for making shaped rings with flexible tooling is possible. Such a process can reduce yield losses and downstream machining costs in low-volume applications.

Figure 10:
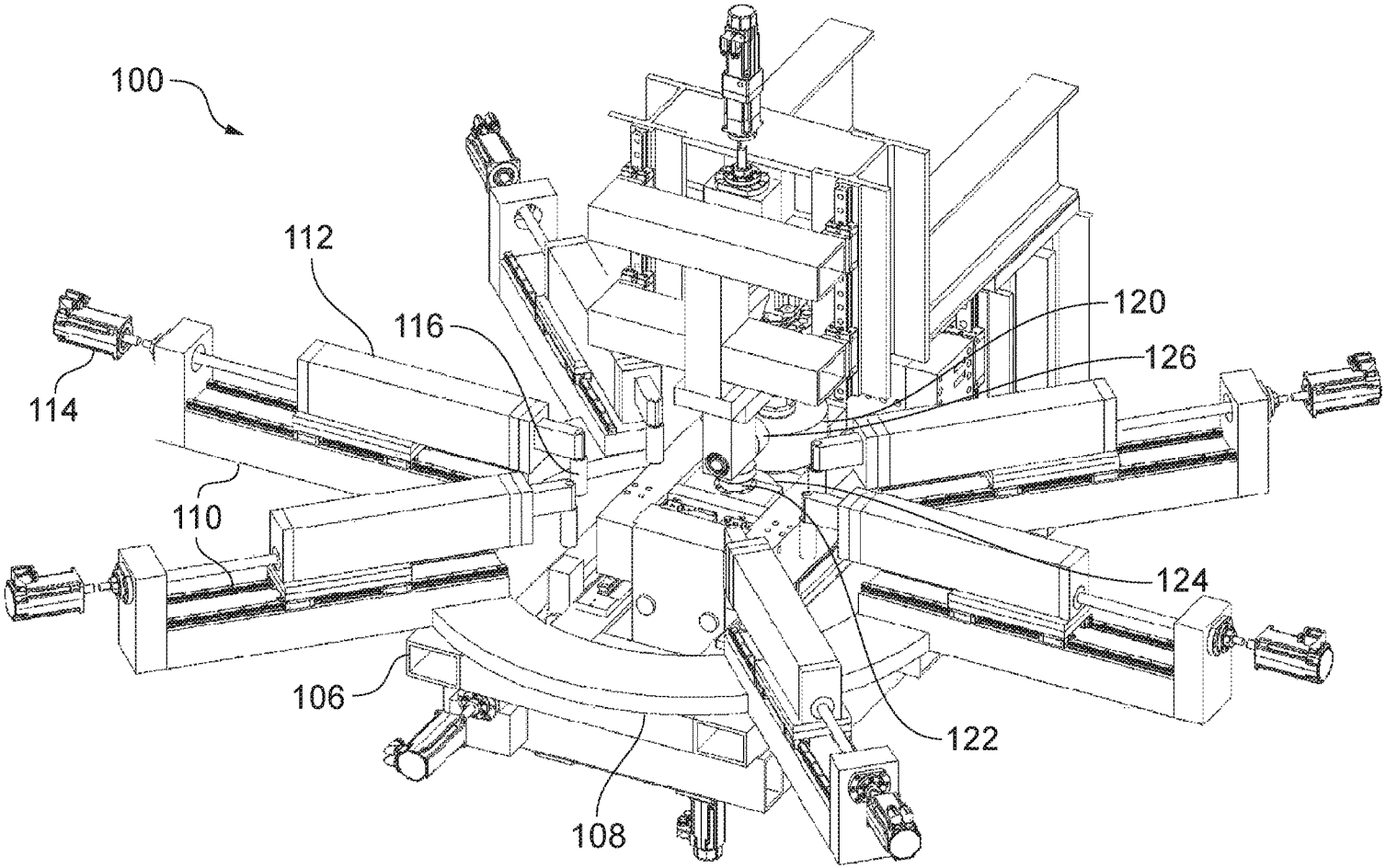
FIG. 10 shows a schematic perspective view of a ring rolling apparatus according to an embodiment of the invention.

FIG. 10 shows one embodiment of a ring rolling apparatus according to the present invention. The apparatus, designated generally as 100, is shown here without the workpieces 102, 104 shown in FIGS. 11 and 13 which are otherwise identical and so use similar reference numbers where applicable.

Figure 13:
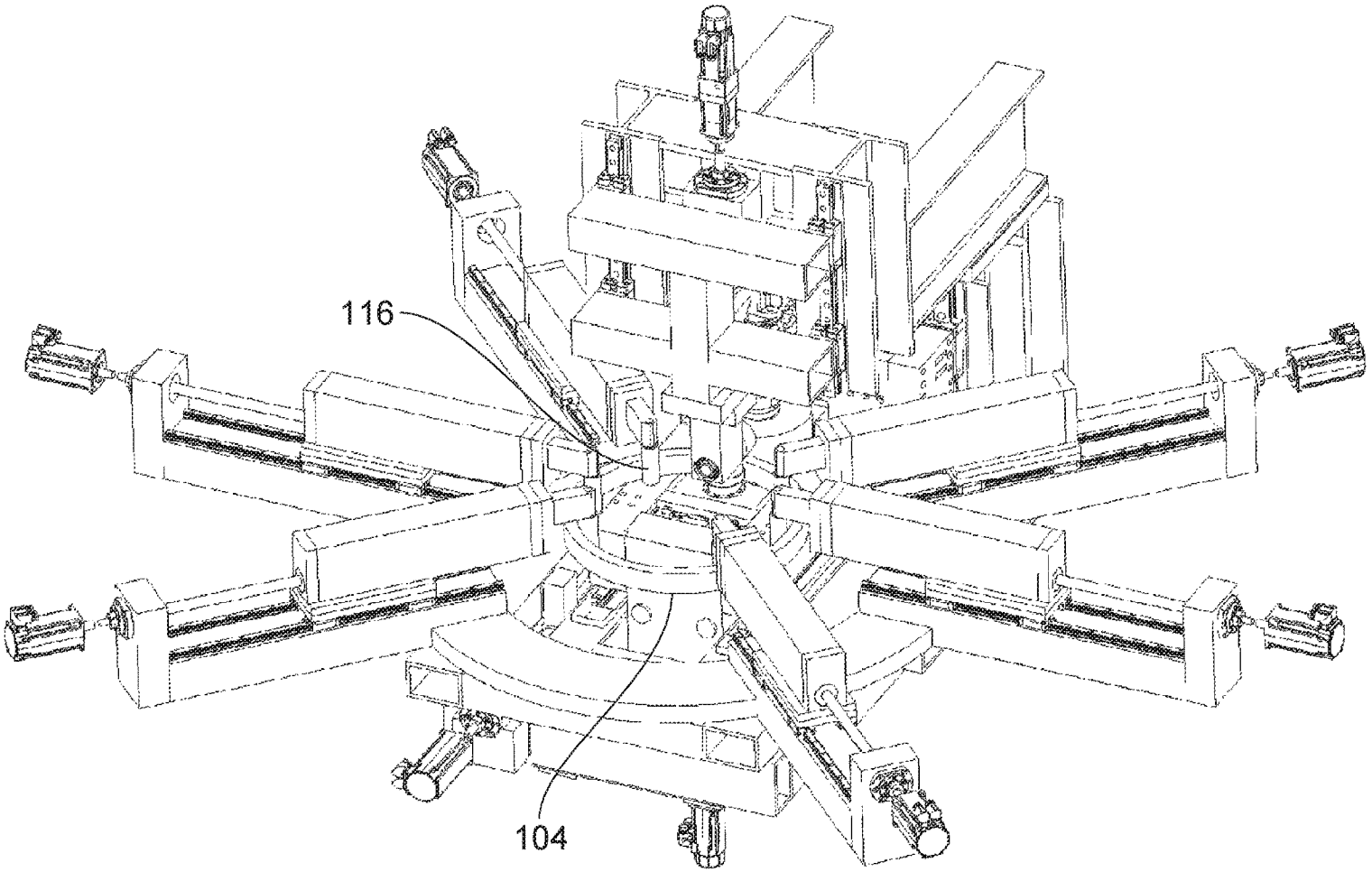
FIG. 13 shows a view similar to FIG. 11 except that the circumferential constraint rolls act on the inner radial surface of the workpiece.

Apparatus 100 includes support table 106 on which is mounted ring-shaped support member 108, having a central axis which is located so as to be coincident with the principal axis of the workpiece. Mounted at different angular positions around ring-shaped support member 108 are support tracks 110. Carriages 112 are linearly movable along support tracks 110 via actuators 114 and have at their forward end axially mounted circumferential constraint rolls 116, adapted to press against either the outer radial surface of the workpiece (FIG. 11) or the inner radial surface of the workpiece (FIG. 13). The circumferential constraint rolls 116 are supported only at one end (here at the top end) in order to allow them to be used at the inner radial surface of the workpiece.

The circumferential constraint rolls 116 are angularly distributed around the apparatus with typically angles of not less than 45° and not more than 90° between adjacent circumferential constraint rolls, as subtended at the central axis of the ring-shaped support member 108, with the possible exception that a greater angle may be subtended between the two circumferential constraint rolls located adjacent the roll bite region, described in more detail below, and opposite the roll bite region.

As discussed above, the ring shaped workpiece has a principal axis, an inner radial surface, an outer radial surface, a first axial surface and a second axial surface. These allow an easier description of the features of the apparatus. The apparatus has a forming roll 120 which is mounted for rotation around a vertical axis and which is driveable by a motor (not shown). The apparatus also has a mandrel roll 122, also mounted for rotation around a vertical axis and which may rotate idly or which may also be driven for rotation by a motor (not shown). Together, the forming roll 120 and the mandrel roll 122 subject the workpiece to radial pressure between them, the forming roll acting on the outer radial surface and the mandrel roll acting on the inner radial surface of the workpiece, at a radial roll bite region.

The apparatus also has a first, lower, axial roll 124 and a second, upper, axial roll 126. These are each rotatable about a horizontal axis, parallel to a radial direction of the workpiece. Together, the first axial roll 124 and the second axial roll 126 subject the workpiece to axial pressure between them, with the first axial roll acting on the first axial surface and the second axial rolls acting on the second axial surface. The first and second axial rolls are positioned in register with each other, in terms of radial and circumferential position. Specifically, the first and second axial rolls are provided at an angular position, measured with respect to the principal axis of the ring shaped workpiece, within ±10° of the radial roll bite region. More preferably, the interaction between the first and second axial rolls and the workpiece defines an axial roll bite region (i.e. a region of contact between the workpiece and the first and second axial rolls), and the axial roll bite region and the radial roll bite region overlap in terms of angular position around the workpiece. In this way, the present inventors consider that the flow of the material of the workpiece can be effectively controlled, allowing the development of relatively complex cross sectional shapes. In effect, the arrangement of rolls recreates the mechanics of closed pass radial rolling but in a flexible manner.

Figure 12:
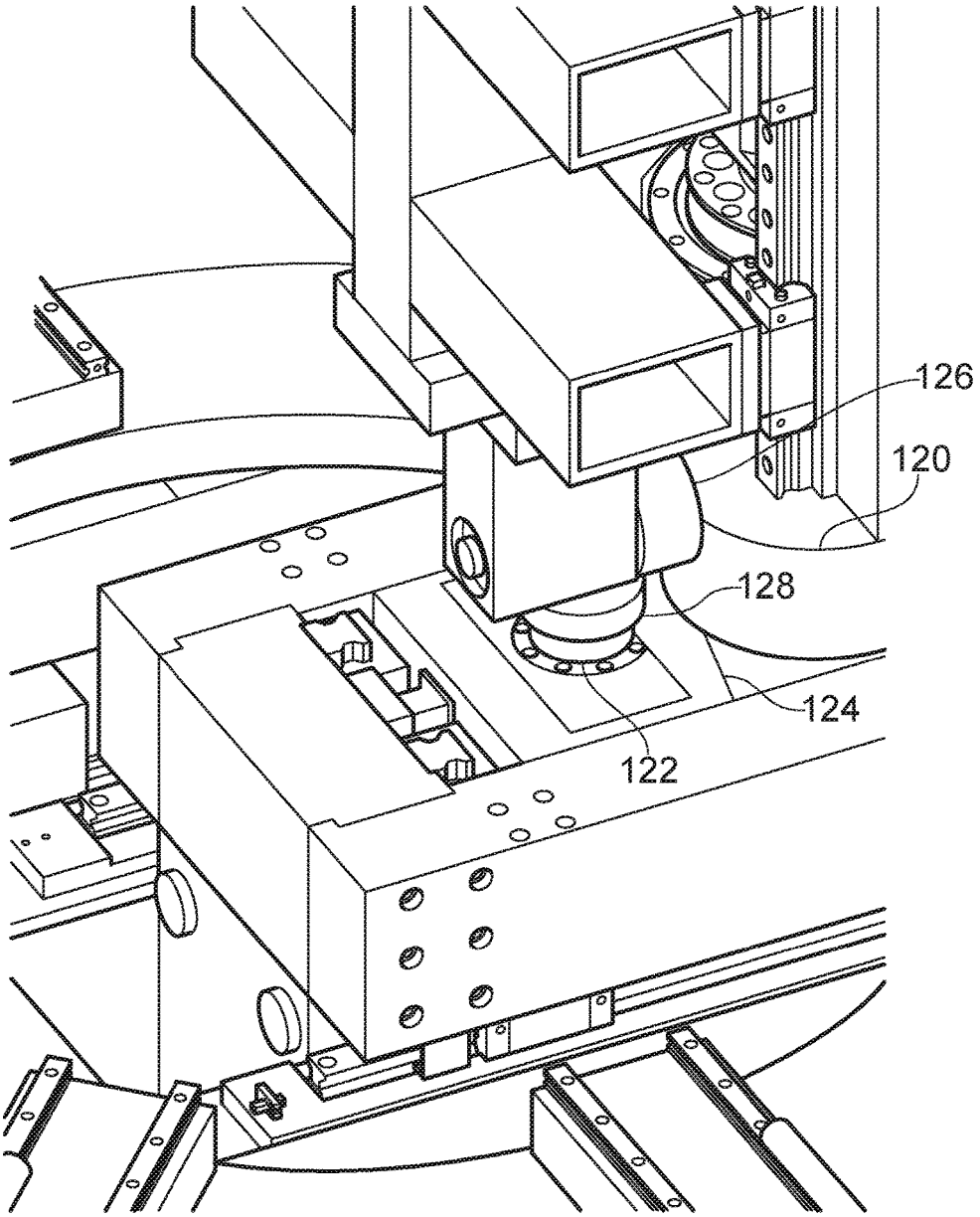
FIG. 12 shows an enlarged view of the working region of the apparatus of FIG. 10.

FIG. 12 shows an enlarged view of the working region of the apparatus of FIG. 10. The workpiece is absent, to allow the features of the apparatus to be seen. Forming roll 120, mandrel roll 122, first axial roll 124 and second axial roll 126 are shown. It can be seen that the mandrel roll 122 has an annular projection 128 with an axial extent that is typically less than the axial height of the workpiece and less than the axial extent of the forming roll. Additionally, the mandrel roll can be moved axially (as well as radially). During use, therefore, control of the movement of the mandrel roll can be used to develop a specific shape to the inner radial surface of the workpiece, and therefore a specific desired cross sectional shape to the workpiece. Unwanted axial flow of the workpiece during this process is restricted and controlled by the first and second axial rolls.

In an alternative embodiment (not shown), the mandrel roll has a cylindrical shape and an axial extent which is at least as large (and preferably larger) than the axial height of the workpiece. In this embodiment, the forming roll has an annular projection with an axial extent that is less than the axial height of the workpiece and less than the axial extent of the mandrel roll. Additionally, the forming roll can be moved axially (as well as radially). During use, therefore, control of the movement of the forming roll can be used to develop a specific shape to the outer radial surface of the workpiece, and therefore a specific desired cross sectional shape to the workpiece. Unwanted axial flow of the workpiece during this process is restricted and controlled by the first and second axial rolls, as in the embodiment described above. In this embodiment, in which the outer radial surface of the workpiece is profiled and the circumferential constraint rolls bear against the outer radial surface, preferably the circumferential constraint rolls also are axially moveable, in register with the forming roll, and the circumferential constraint rolls have a similar profile shape to the forming roll.

In a further alternative embodiment (not shown), both the mandrel roll and the forming roll have annular projections of the type described above, and both are moveable axially. This allows the development of specific shapes to the inner and outer radial surfaces, further increasing the flexibility of the apparatus to develop complex cross sectional ring shapes. In this case, the circumferential constraint rolls preferably have the form described in the preceding paragraph, with a shape and axial movement matched to the mandrel roll if the circumferential constraint rolls bear against the inner radial surface or matched to the forming roll if the circumferential constraint rolls bear against the outer radial surface of the workpiece.

As explained in the preliminary modelling and experimental work reported above, hoop stress in the workpiece is considered to play an important role in the development of suitable complex geometries in flexible radial ring rolling. Accordingly, the circumferential constraint rolls 116 are deployed in order to control the hoop stress, and in addition stabilise and centralise the workpiece during operation of the apparatus. Using at least three circumferential constraint rolls is expected to assist in the control of the hoop stress, and the inventors consider that use of up to seven circumferential constraint rolls would provide greater control of the hoop stress and this more control over the development of the required cross sectional shape.

Figure 11:
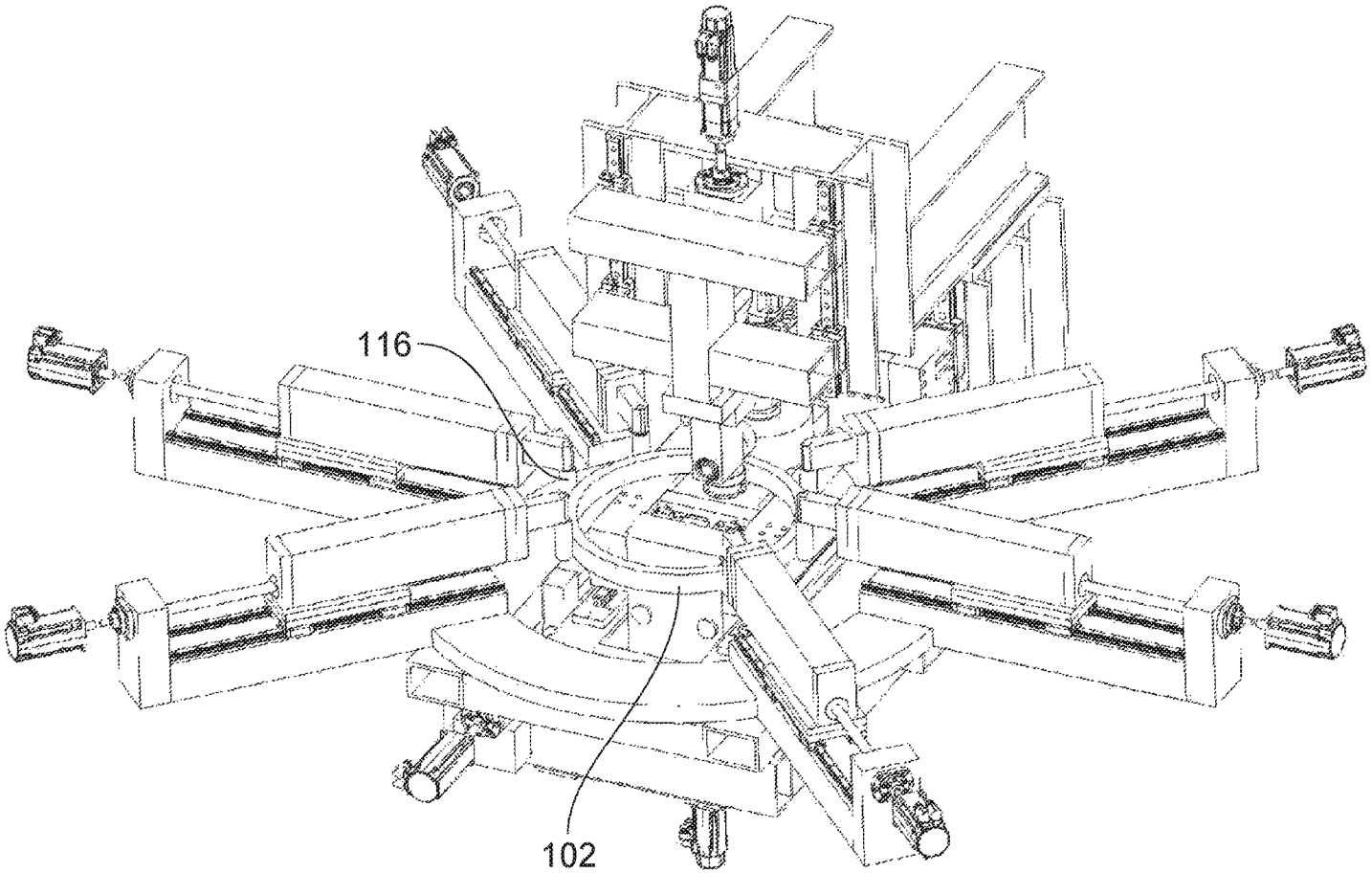
FIG. 11 shows a view similar to FIG. 10 except that a workpiece is shown in the apparatus.

It should be noted that FIG. 11 has the circumferential constraint rolls 116 acting on the outer radial surface, therefore promoting compressive hoop stress. In contrast, FIG. 13 has the circumferential constraint rolls 116 acting on the inner radial surface, therefore promoting tensile hoop stress.

The present inventors consider that the provision of the circumferential constraint rolls in the embodiment described above is of interest also in ring rolling techniques where the mandrel roll and the forming roll are each plain cylindrical rolls. Therefore, in a further alternative embodiment (not shown), the circumferential constraint rolls are used in conjunction with cylindrical mandrel and forming rolls and with the first and second axial rolls at the radial roll bite as described above. The additional control over compressive or tensional hoop stress further enhances the control over the material flow at the roll bite. It is noted that Reference 11 uses a large metal sleeve to completely prevent circumferential flow. However, this is inflexible, requiring a new sleeve for each part.

Figure 14:
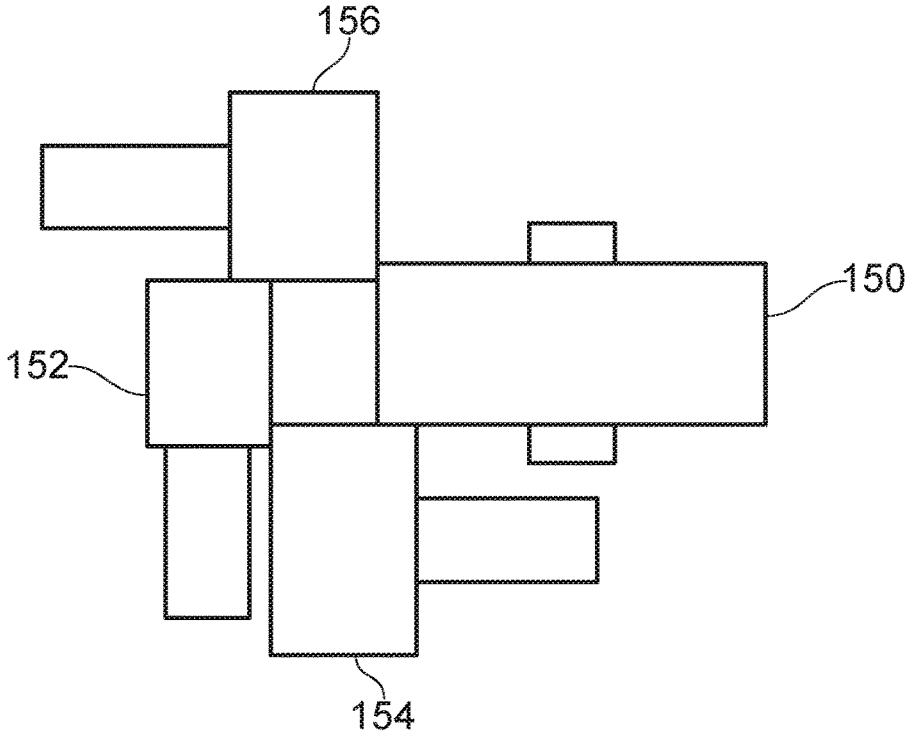
FIG. 14 shows a schematic cross sectional view of the roll bite region formed by the radial and axial rolls of a reference example, not inside the scope of the invention.

FIG. 14 shows a schematic cross sectional view of the roll bite region formed by the radial and axial rolls of a reference arrangement, which is not inside the scope of the present invention. Here, the forming roll 150 and the mandrel roll 152 have a plain cylindrical shape and rotate about vertical axes. The first (lower) axial roll 154 and the second (upper) axial roll 156 also have a plain cylindrical shape and rotate about horizontal axes. The forming roll 150 and the mandrel roll 152 are independently moveable along their axes of rotation (i.e. to translate up and down) in addition to being rotatable and independently moveable radially. Similarly, the first and second axial rolls 154, 156 are moveable, either independently or together with the mandrel roll and/or forming roll, along their axes of rotation (i.e. to translate radially) in addition to being rotatable and independently moveable vertically. Cooperation of the translation of the rolls 150, 152, 154 and 156 allows them to fit together as shown at the roll bite region, in order to adapt to the changing cross section of the workpiece during forming, but the resultant cross sectional shape of the workpiece being limited to a rectangular cross sectional shape.

Figure 15:
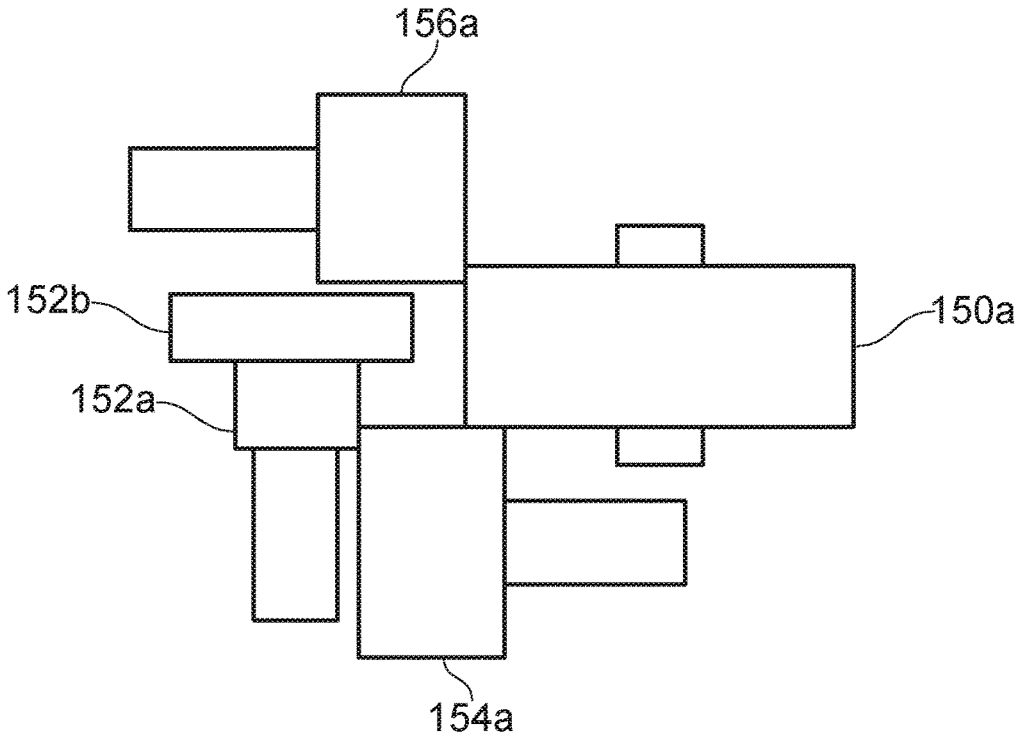
FIG. 15 shows a schematic cross sectional view of the roll bite region formed by the radial and axial rolls of an embodiment of the invention.

FIG. 15 shows a schematic cross sectional view of the roll bite region formed by the radial and axial rolls of an embodiment of the invention. This is a modification of FIG. 14, the modification here being provided at the mandrel roll. Here, the forming roll 150*a* has a plain cylindrical shape and rotates about a vertical axis. The first (lower) axial roll 154*a* and the second (upper) axial roll 156*a* also have a plain cylindrical shape and rotate about horizontal axes. It is preferred that the forming roll 150*a* is moveable along its axis of rotation (i.e. to translate up and down) in addition to being rotatable and independently moveable radially. Similarly, the first and second axial rolls 154*a*, 156*a* are independently moveable along their axes of rotation (i.e. to translate radially) in addition to being rotatable and independently moveable vertically. Mandrel roll 152*a* rotates about a vertical axis and is moveable along its axis of rotation (i.e. to translate up and down) in addition to being rotatable and independently moveable radially. Mandrel roll 152*a* has an annular projection 152*b* that is relatively narrow in axial extent compared with, for example, the forming roll.

Control of the translation of the mandrel roll therefore allows the development of relatively complex shapes for the inner radial surface of the workpiece and correspondingly complex cross sectional shapes for the workpiece.

FIGS. 16-21 show a complex cross sectional shape formed from an initial ring-shaped workpiece using ring rolling process according to an embodiment of the invention.

Figure 16:
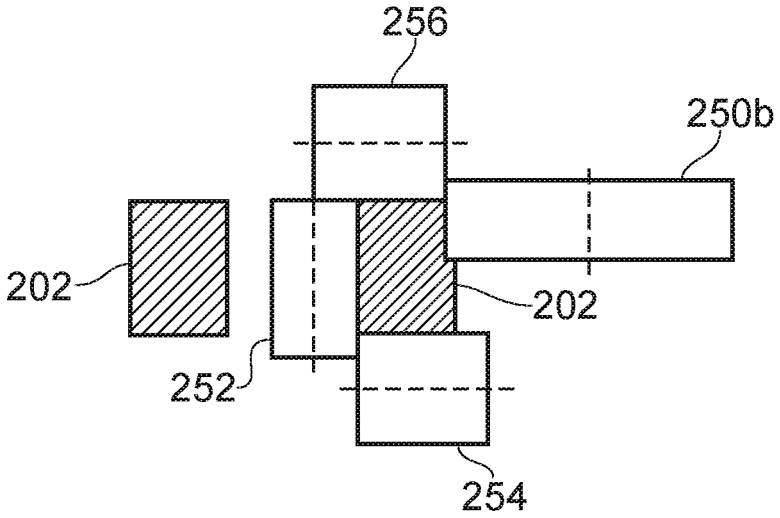
FIGS. 16-21 show a complex cross sectional shape formed from an initial ring-shaped workpiece using ring rolling process according to an embodiment of the invention.
Figure 17:
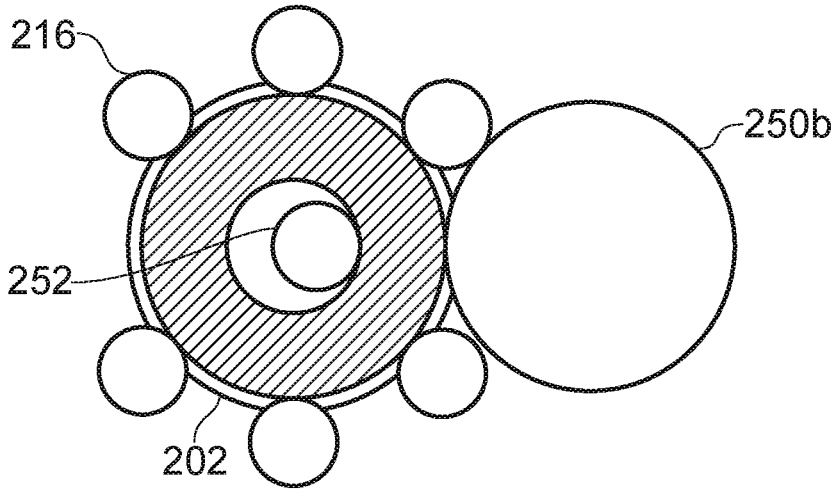

FIG. 16 shows the workpiece 202 in cross section parallel to its axis of rotation in an apparatus according to an embodiment of the invention (shown schematically) at the beginning of the ring rolling process. FIG. 17 shows the workpiece at substantially the same stage of the process, in a cross section perpendicular to its axis of rotation.

Mandrel roll 252 bears against the radially inner surface of the workpiece 202. Mandrel roll 252 has an axial height sufficient to contact the entire axial height of the workpiece. In this embodiment, the mandrel roll is not moved axially, only radially in order to ensure the increase in radius of the workpiece during the process. Forming roll 250*b* has an axial height which is less than the starting axial height of the workpiece. The effect of this is that forming roll 250*b* makes contact with only part of the outer radial surface of the workpiece during a revolution of the workpiece. In FIG. 16, the forming roll 250*b* makes contact with the upper part of the outer radial surface of the workpiece.

Upper 256 and lower 254 axial rolls make contact with the upper and lower axial surfaces of the workpiece 202, respectively.

Six circumferential constraint rolls 216 are provided, as shown in FIG. 17. These control and maintain compressive hoop stress in the workpiece during the process, as described above.

The effect of the forming roll 250*b* bearing against only the upper part of the outer radial surface of the workpiece 202 is that a step-shaped profile is developed in the outer radial surface of the workpiece 202.

Figure 18:
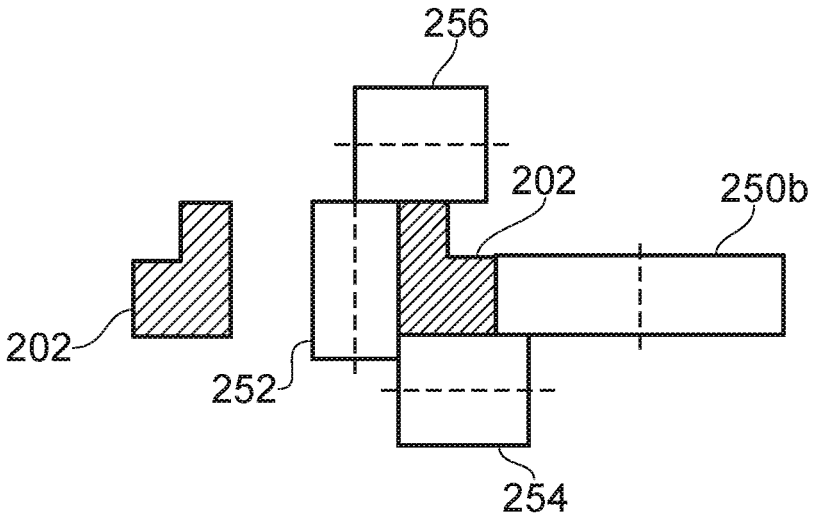
Figure 19:
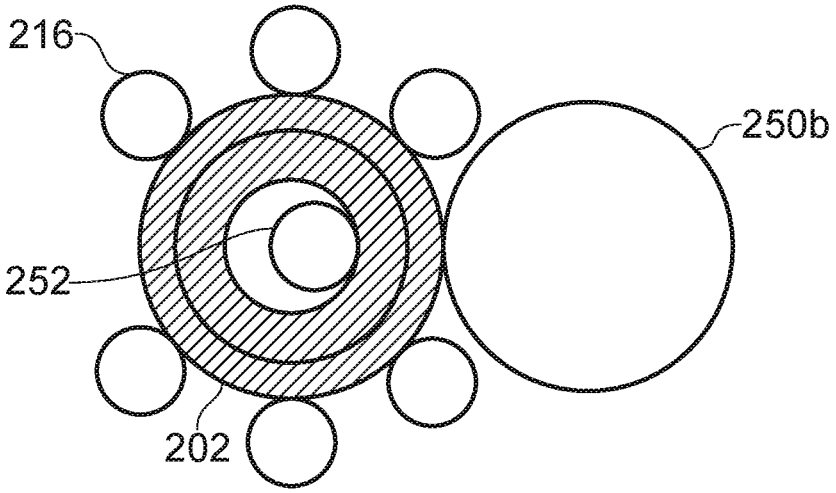

FIGS. 18 and 19 show a later stage in the same ring rolling process. Similarly to FIGS. 16 and 17, FIG. 18 shows the workpiece 202 in cross section parallel to its axis of rotation at an intermediate time during the ring rolling process. FIG. 19 shows the workpiece at substantially the same stage of the process, in a cross section perpendicular to its axis of rotation.

In FIGS. 18 and 19, the step-shaped profile of the workpiece has been developed to a substantial degree. Subsequently, the forming roll 250*b* has been moved axially relative to the workpiece and relative to the mandrel roll 252, to bear against the remaining part of the outer radial surface of the workpiece.

Figure 20:
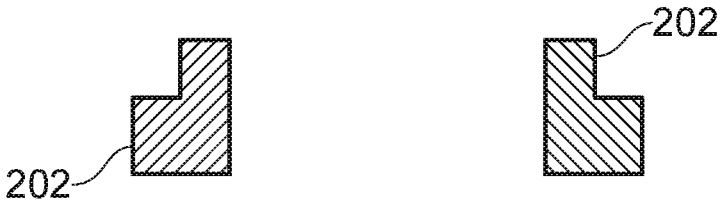
Figure 21:
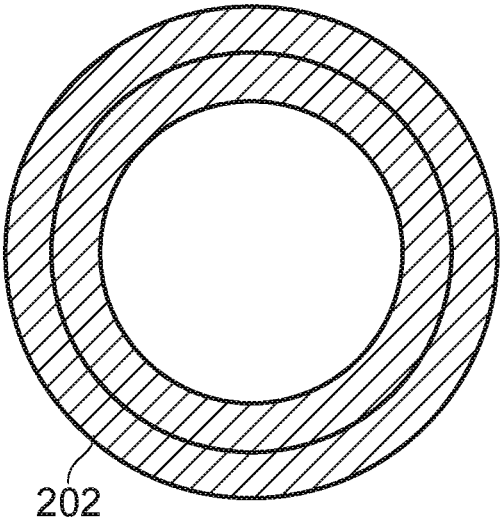

The shape of the finished workpiece is shown in FIG. 20 (cross section parallel to the axis of rotation) and FIG. 21 (cross section perpendicular to the axis of rotation). As a result of the part of the process shown in FIGS. 18 and 19, the diameter of the workpiece has been enlarged further compared with FIGS. 18 and 19, and the depth of the step at the outer radial surface has been reduced due to the work carried out on the lower part of the outer radial surface of the workpiece, with the material flow guided and constrained by the mandrel roll and the upper and lower axial rolls, and the circumferential constraint rolls 216 providing stabilising compressive hoop stress and bearing against the same axial part of the outer radial surface of the workpiece as the forming roll 250*b*.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above and/or listed below are hereby incorporated by reference.

LIST OF NON-PATENT REFERENCES

[1] Hawkyard, J. B., & Moussa, G.: Studies of Profile Development and Roll Force in Profile Ring Rolling. Proceedings of the 3rd International Conference on Rotary Metalwork Processes (1984) pp 301-310

[2] Marczinski, H. J.: The Hot Ring Rolling Process and its Integration into Automatic Production Lines. Proceedings of the 3rd International Conference on Rotary Metalwork Processes (1984). pp. 251-265.

[3] Qian, D.-S., Hua, L., & Pan, L.-B.: Blank design optimisation for T-section ring rolling. Ironmaking & Steelmaking, (2009) 36(6),

[4] Souza, U. De, Vaze, S., Pursell, Z., & Phillips, K. Profile Ring Rolling. Advanced Materials & Processes, (2003) May 35-37.

[5] Tiedemann, I., Hirt, G., Kopp, R., Michl, D., & Khanjari, N.: Material flow determination for radial flexible profile ring rolling. Production Engineering, (2007) 1(3)

[6] Qian, D., Hua, L., & Deng, J.: FE analysis for radial spread behavior in three-roll cross rolling with small-hole and deep-groove ring. Transactions of Nonferrous Metals Society of China, (2012) 22

[7] Han, X., Hua, L., Zhou, G., Lu, B., & Wang, X.: FE simulation and experimental research on cylindrical ring rolling. Journal of Materials Processing Technology, (2014) 214(6), 1245-1258.

[8] Ficker, T., Hardtmann, A., & Houska, M. Ring Rolling Research at the Dresden University of Technology—its History from the Beginning in the 70 s to the Present. Steel Research International. (2005)

[9] Stanistreet, T. F., Allwood, J. M., & Willoughby, A. M.: The design of a flexible model ring rolling machine. Journal of Materials Processing Technology, (2006). 177 (1-3), 630-633

[10] Erman, E., & Semiatin, S. L. (Eds.). Physical Modeling of Metalworking Processes. Warrendale, Pa. Metallurgical Society (1987)

[11] Xinghui Han, Lin Hua, Guanghua Zhou, Bohan Lu, Xiaokai Wang; A new cylindrical ring rolling technology for manufacturing thin-walled cylindrical ring, International Journal of Mechanical Sciences, Volume 81, April 2014, Pages 95-108

The invention claimed is:

1. A ring rolling process comprising:

providing a ring shaped workpiece, the ring shaped workpiece having a principal axis, an inner radial surface, an outer radial surface, a first axial surface and a second axial surface;

subjecting the workpiece to radial pressure between a forming roll acting on the outer radial surface and a mandrel roll acting on the inner radial surface, at a radial roll bite region, wherein:

a first axial roll and a second axial roll are provided at the first axial surface and the second axial surface respectively, to subject the workpiece to axial pressure, the first and second axial rolls being provided at an angular position, measured around the workpiece and with respect to the principal axis, within ±10° of said radial roll bite region;

and, in order to control the cross sectional shape of the workpiece at least one of the following conditions (i) and (ii) applies:

(i) the mandrel roll has a projecting portion for contact with the workpiece, the projecting portion having an axial extent which is smaller than the axial height of the workpiece, the mandrel roll being axially moveable relative to the workpiece during the ring rolling process so that the projecting portion is applied to different axial locations of the workpiece, in order to control the shape applied to the workpiece;

and (ii) the forming roll has a projecting portion for contact with the workpiece, the projecting portion having an axial extent which is smaller than the axial height of the workpiece, the forming roll being axially moveable relative to the workpiece during the ring rolling process so that the projecting portion is applied to different axial locations of the workpiece, in order to control the shape applied to the workpiece;

and wherein the first and second axial rolls are independently moved to adapt to the changing cross section of the workpiece during forming.

2. The ring rolling process according to claim 1 wherein an axial roll bite region and the radial roll bite region overlap in terms of angular position around the workpiece.

3. The ring rolling process according to claim 1 wherein circumferential constraint rolls are provided to act on the outer radial surface or inner radial surface of the workpiece.

4. The ring rolling process according to claim 3 wherein the circumferential constraint rolls act to control the compressive or tensional hoop stress in the workpiece.

5. The ring rolling process according to claim 3 wherein there are provided more than two circumferential constraint rolls.

6. The ring rolling process according to claim 5 wherein the more than two circumferential constraint rolls are angularly distributed substantially regularly around the workpiece.

7. The ring rolling process according to claim 3 wherein the circumferential constraint rolls have the same shape as the mandrel and/or forming rolls and are similarly axially moveable relative to the workpiece.

8. A ring rolling apparatus for ring rolling a ring shaped workpiece, the ring shaped workpiece having a principal axis, an inner radial surface, an outer radial surface, a first axial surface and a second axial surface, the ring rolling apparatus comprising:

a forming roll and a mandrel roll, for subjecting the workpiece to radial pressure between a forming roll acting on the outer radial surface and a mandrel roll acting on the inner radial surface, at a radial roll bite region, and;

a first axial roll and a second axial roll, for subjecting the workpiece to axial pressure between the first axial surface and the second axial surface respectively, the first and second axial rolls being provided at an angular position, measured around the workpiece and with respect to the principal axis of the ring shaped workpiece, within ±10° of said radial roll bite region, wherein, in order to control the cross sectional shape of the workpiece at least one of the following conditions (i) and (ii) applies:

(i) the mandrel roll has a projecting portion for contact with the workpiece, the projecting portion having an axial extent which is smaller than the axial height of the workpiece, the mandrel roll being axially moveable relative to the workpiece, so that the projecting portion is capable of being applied to different axial locations of the workpiece, in order to control the shape applied to the workpiece;

and (ii) the forming roll has a projecting portion for contact with the workpiece, the projecting portion having an axial extent which is smaller than the axial height of the workpiece, the forming roll being axially moveable relative to the workpiece, so that the projecting portion is capable of being applied to different axial locations of the workpiece, in order to control the shape applied to the workpiece;

and wherein the first and second axial rolls are independently moveable to adapt to the changing cross section of the workpiece during forming.

9. The ring rolling apparatus according to claim 8 wherein an axial roll bite region and the radial roll bite region overlap in terms of angular position around the workpiece.

10. The ring rolling apparatus according to claim 8 wherein circumferential constraint roll are provided to act on the outer radial surface or inner radial surface of the workpiece.

11. The ring rolling apparatus according to claim 10 wherein the circumferential constraint rolls act to control the compressive or tensional hoop stress in the workpiece.

12. The ring rolling apparatus according to claim 10 wherein there are provided more than two circumferential constraint rolls.

13. The ring rolling apparatus according to claim 12 wherein the more than two circumferential constraint rolls are angularly distributed substantially regularly around the workpiece.

14. The ring rolling apparatus according to claim 10 wherein the circumferential constraint rolls have the same shape as the mandrel and/or forming rolls and are similarly axially moveable relative to the workpiece.

* * * * *